United States Patent [19]

Toone

[11] 4,148,166

[45] Apr. 10, 1979

[54] INSULATED CONSTRUCTION BLOCK

[76] Inventor: Charles A. Toone, 4200 Lorcom La., Arlington, Va. 22207

[21] Appl. No.: 883,286

[22] Filed: Mar. 3, 1978

[51] Int. Cl.[2] ..... E04B 2/42; E04C 2/10

[52] U.S. Cl. ..... 52/309.12; 52/270; 52/405; 52/586; 52/604

[58] Field of Search ..... 52/586, 593, 309.11, 52/309.12, 405, 309.4, 404, 606

[56] References Cited

U.S. PATENT DOCUMENTS

| | | | |
|---|---|---|---|
| 2,319,203 | 5/1943 | Branham | 52/605 |
| 2,961,478 | 11/1960 | Burns | 52/586 |
| 3,204,381 | 9/1965 | Perreton | 52/309.12 |
| 3,936,987 | 2/1976 | Calvin | 52/586 |

FOREIGN PATENT DOCUMENTS

| | | | |
|---|---|---|---|
| 905060 | 1/1954 | Fed. Rep. of Germany | 52/593 |
| 979305 | 4/1951 | France | 52/607 |
| 521167 | 3/1955 | Italy | 52/605 |

*Primary Examiner*—John E. Murtagh

*Attorney, Agent, or Firm*—Charles P. Boukus, Jr.

[57] ABSTRACT

An insulated construction block incorporates improved insulating features which minimize thermal conduction through the block itself and through mortar joints between adjacent blocks in a masonry wall. The block includes a recessed end face designed to receive an insulation insert in a vertical mortar joint between adjacent blocks and to maximize the amount of insulation in the mortar joint. The recess overlaps interior insulating spaces within the construction block to minimize heat loss through the end walls of the block. The insulating inserts received in the mortar joint and interior insulating spaces are greater in height than the block to project into the horizontal mortar joints above or below the block.

16 Claims, 18 Drawing Figures

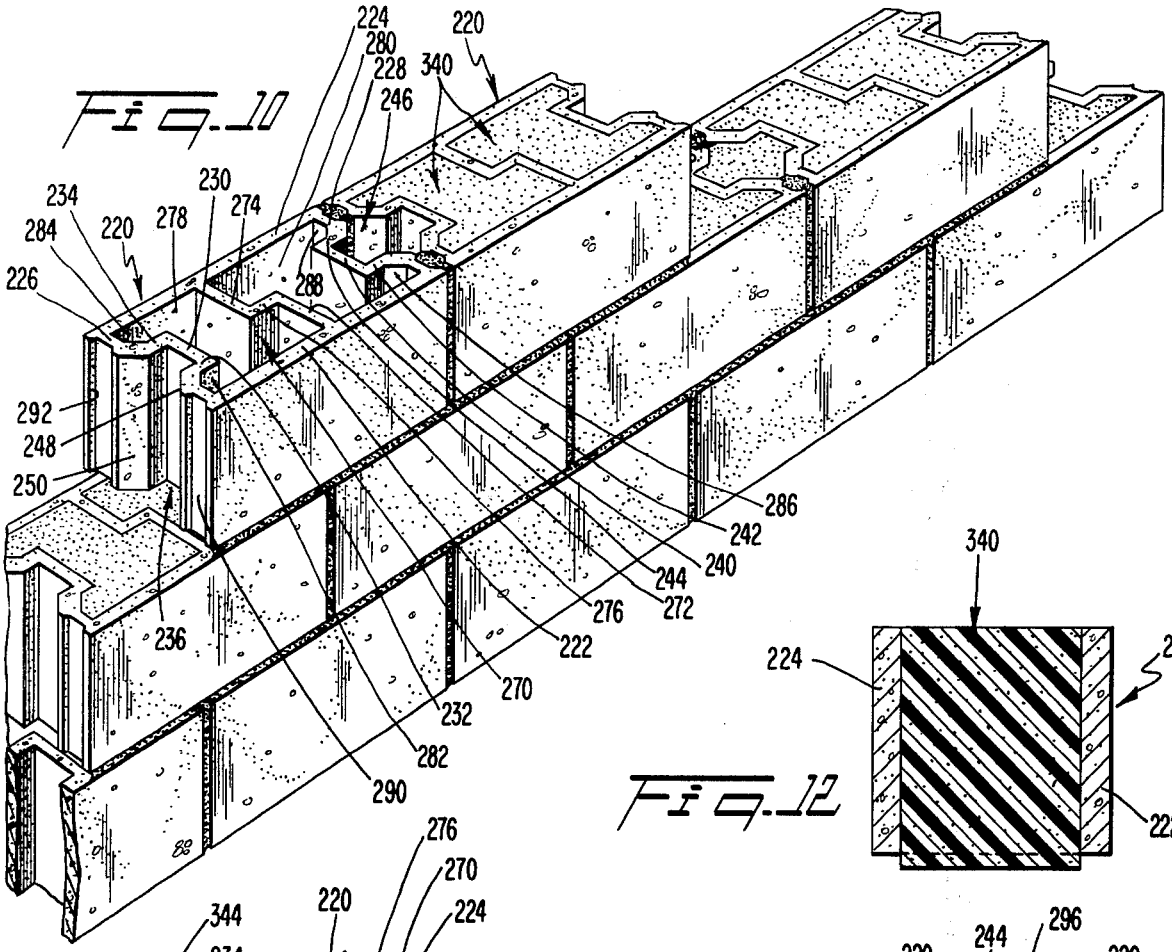
Fig. 10
Fig. 12
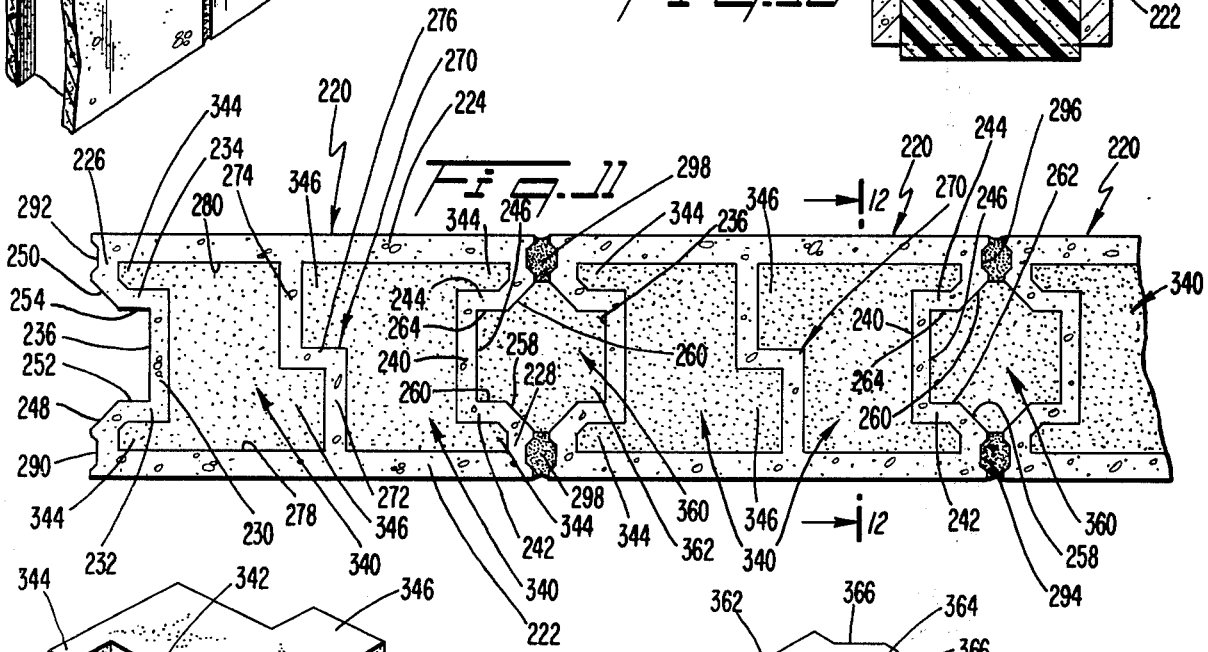
Fig. 11
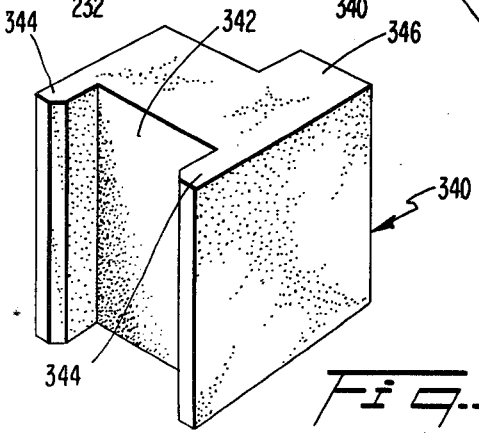
Fig. 13
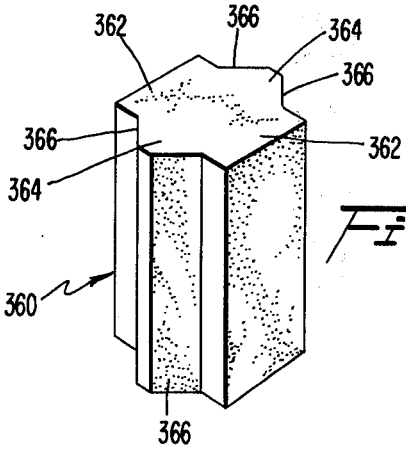
Fig. 14

Fig. 15
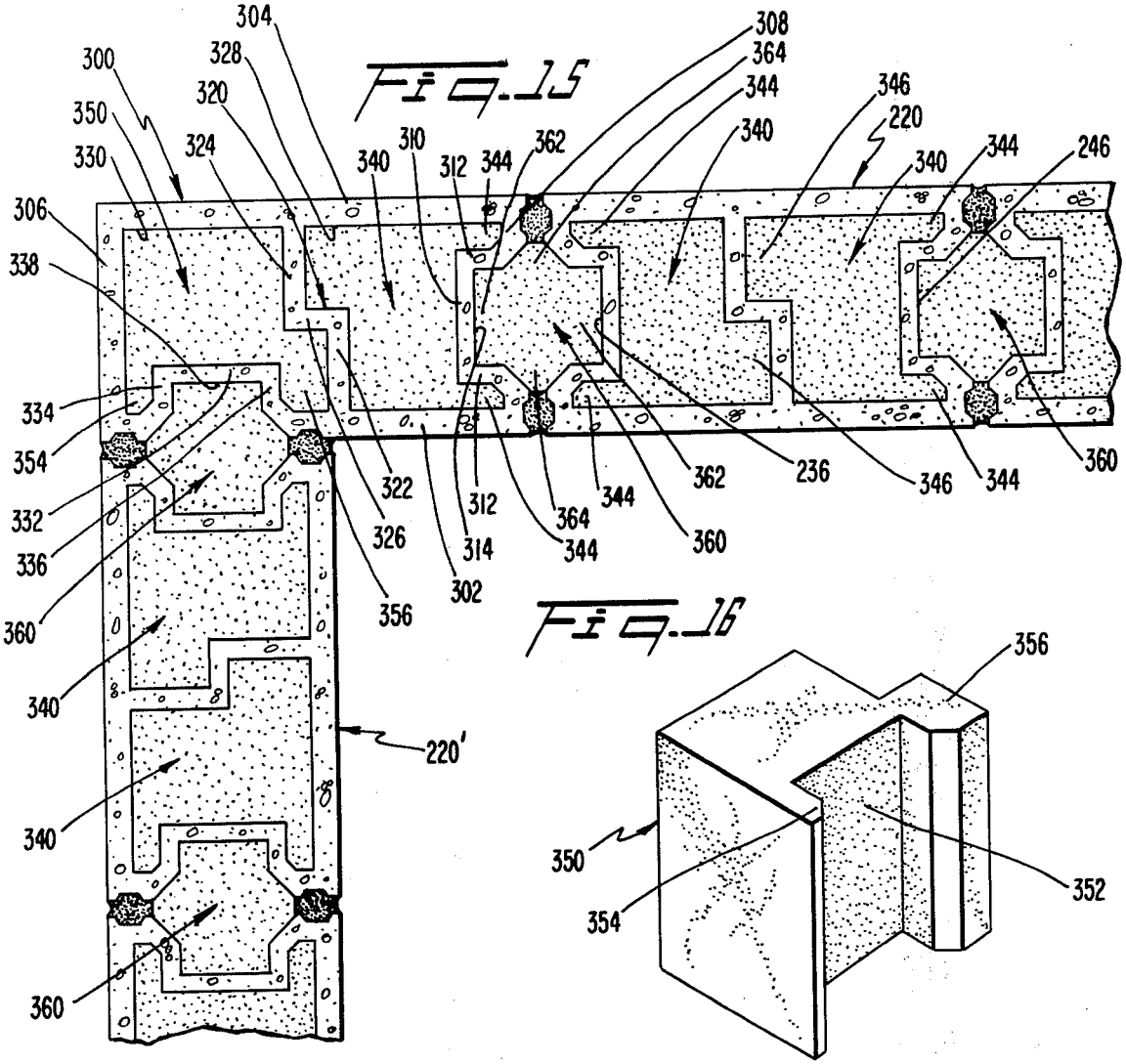
Fig. 16
Fig. 17
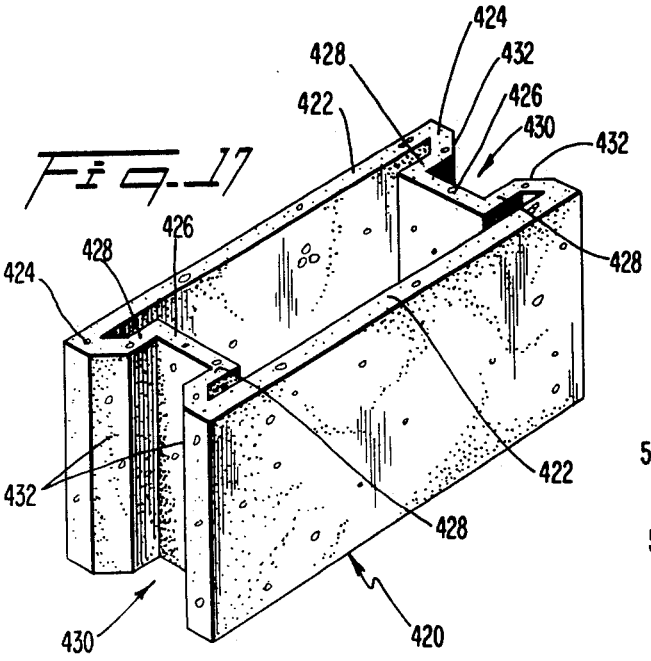
Fig. 18
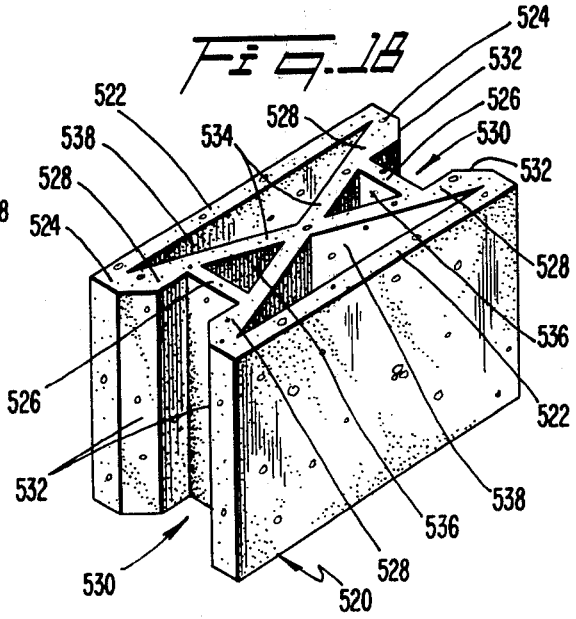

INSULATED CONSTRUCTION BLOCK

BACKGROUND OF THE INVENTION

1. Field of Invention

The present invention relates to a construction block for use in masonry walls and, more particularly, to an insulated concrete construction block provided with improved insulating features which minimize thermal conduction through the block itself and through mortar joints between adjacent blocks in a masonry wall.

2. Description of the Prior Art

Conventional masonry construction of buildings employs pre-cast concrete blocks arranged end to end in rows and secured together by vertical mortar joints between adjacent blocks. Successive rows of blocks are secured to those below by horizontal mortar joints. Generally, the concrete blocks have a hollow interior to reduce the weight and facilitate handling of the blocks by workmen. One widely used construction block includes a central web extending transversely across the hollow interior of the block to connect the side walls of the block and preserve its strength.

Generally, such conventional construction blocks have relatively poor insulative value. The concrete material of the block allows appreciable thermal conduction, particularly at the end walls and central web where straight conductive paths are provided which allow direct heat conduction between the inner and outer side walls of the block. In addition, when such conventional blocks are assembled in a masonry wall, the vertical mortar joints between adjacent blocks and the horizontal mortar joints between successive rows of blocks are poorly insulated. Typically, air spaces in the mortar joints between the blocks allow sufficient air circulation to result in loss of heat by convection. Similarly, air is able to circulate through the hollow interior of the blocks resulting in additional loss of heat. Thus, such a masonry wall has usually been insulated by installation of a separate insulative barrier, e.g., conventional studs or furring strips with fiberglass or other insulation, on the inner face of the wall.

Although it has been proposed to utilize insulation inserts in the hollow interior spaces of conventional masonry blocks, such arrangements have not provided satisfactory insulative characteristics because of the loss of heat by conduction through the central web and end walls of the block. Further, no provision has been made to prevent loss of heat through the mortar joints between adjacent blocks.

In addition, various proposals have been made in the prior art to provide alternate forms of insulated masonry blocks by eliminating the centrally located transverse web of the conventional block and providing other interior configurations to achieve one or more hollow insulating spaces for receiving insulating material within the block. However, such proposals have generally sacrificed the overall strength of the conventional block without appreciably improving its insulative characteristics. Moreover, the complex internal configuration of such insulated blocks has made the blocks difficult and expensive to manufacture and install. Consequently, such insulated masonry blocks have not received widespread acceptance in the construction industry.

Nevertheless, because of the presently increasing concern about dwindling sources of conventional fossil fuels and the need to adequately insulate building walls, there is definitely a need for an insulated construction block which is simple and effective in design and capable of manufacture and installation at reasonable cost. A primary consideration in the design of a satisfactory insulated construction block is to maximize the insulative properties without sacrificing the strength of the block. To limit heat loss through the concrete material of the block itself, it is necessary to achieve a concrete block structure which eliminates direct paths for thermal conduction through the block. Furthermore, it is important that the construction block achieve adequate insulation in the mortar joints between adjacent blocks in the same row and between successive rows of blocks.

SUMMARY OF THE INVENTION

An object of the present invention is to provide an insulated construction block having enhanced insulating characteristics and preserving the strength of conventional blocks.

Another object of the invention is to achieve an insulated construction block which effectively provides insulation in the mortar joints between adjacent blocks and between successive rows of blocks in a masonry wall.

It is also an object of the invention to provide an insulated construction block having a recessed end face designed to receive insulating material between adjacent blocks to maximize the amount of insulation provided in the mortar joint between the blocks.

Another object of the invention is to achieve an insulated construction block provided with a central recess in its end face which overlaps one or more interior insulating spaces to minimize thermal conduction through the block.

A further object of the invention is to provide an insulated construction block having hollow interior regions designed to accommodate an optimum amount of insulating material.

The invention is embodied in a construction block comprising a pair of spaced vertical side walls which provide an inner side wall and an outer side wall of the block and a pair of end walls connected to opposite ends of the vertical side walls to define a hollow interior region within the block for receiving insulating material wherein at least one of the end walls includes an intermediate portion offset inwardly into the hollow interior region to provide a vertical recess on the exterior of the end wall for receiving insulating material. The recess includes an enlarged portion adjacent to the exterior of the end wall to increase the amount of insulating material received therein.

A preferred embodiment of the construction block includes a longitudinal web extending from the offset portion of one end wall to the opposite end wall and spaced from the vertical side walls to form longitudinal insulating spaces adjacent to the inner side wall and the outer side wall. In addition, the recess includes an outwardly flared portion adjacent to the exterior of the end wall and an inner portion overlapping the longitudinal insulating spaces to minimize thermal conduction through the block. Preferably, the longitudinal web is reduced in thickness relative to the side walls to accommodate an increased amount of insulating material within the longitudinal insulating spaces.

The preferred embodiment also includes an insert of insulating material adapted for insertion into the recess to provide insulation in a mortar joint adjacent to the end wall of the block. In addition, a pair of inserts of insulating material is adapted for insertion into the longitudinal insulating spaces to provide insulation inside the block. Each insulating insert exceeds the vertical side walls and end walls in height allowing the insert to project above or below the block to provide insulation in the horizontal mortar joints between successive rows of blocks.

In an alternative embodiment, a connecting web extends transversely between the vertical side walls and includes first and second transverse portions projecting inwardly at longitudinally spaced locations from the inner side wall and the outer side wall, respectively, and a third longitudinal portion connecting the first and second transverse portions. Another alternative embodiment includes a pair of connecting webs extending in a crisscross configuration between the opposite end walls of the block.

The invention provides insulated construction blocks which achieve high levels of insulative value without reduction in the strength of the block. In addition, the insulated construction blocks are particularly effective in providing insulation in the mortar joints of a masonry wall to minimize thermal conduction through the wall. The specifically disclosed embodiments provide configurations which are suitable not only for large eight inch (8") and twelve inch (12") construction blocks, but also for smaller four inch (4") and six inch (6") blocks usually used as a backup for a brick face wall.

BRIEF DESCRIPTION OF THE DRAWINGS

The accompanying drawings illustrate preferred embodiments of the present invention and, together with the description, serve to explain the principles of the invention.

FIG. 10 is a perspective view of a masonry wall including an alternative embodiment of the construction block constructed in accordance with the present invention;

FIG. 11 is an enlarged plan view of a portion of the masonry wall of FIG. 10;

FIG. 12 is a vertical section of the construction block taken along line 12—12 of FIG. 11;

FIG. 13 is a perspective view of an insert of insulating material adapted to be inserted into hollow interior spaces provided in the construction block of FIGS. 10 and 11;

FIG. 14 is a perspective view of an insulating insert adapted to be inserted between adjacent construction blocks;

FIG. 15 is an enlarged plan view of a masonry wall including a corner block similar in structure to the construction block of FIGS. 10 and 11;

FIG. 16 is a perspective view of an insert of insulating material adapted to be inserted inside the corner block of FIG. 15; and FIGS. 17 and 18 illustrate further alternative embodiments of the construction block of the present invention.

DETAILED DESCRIPTION OF THE PREFERRED EMBODIMENTS

Figures 1, 2, 3:
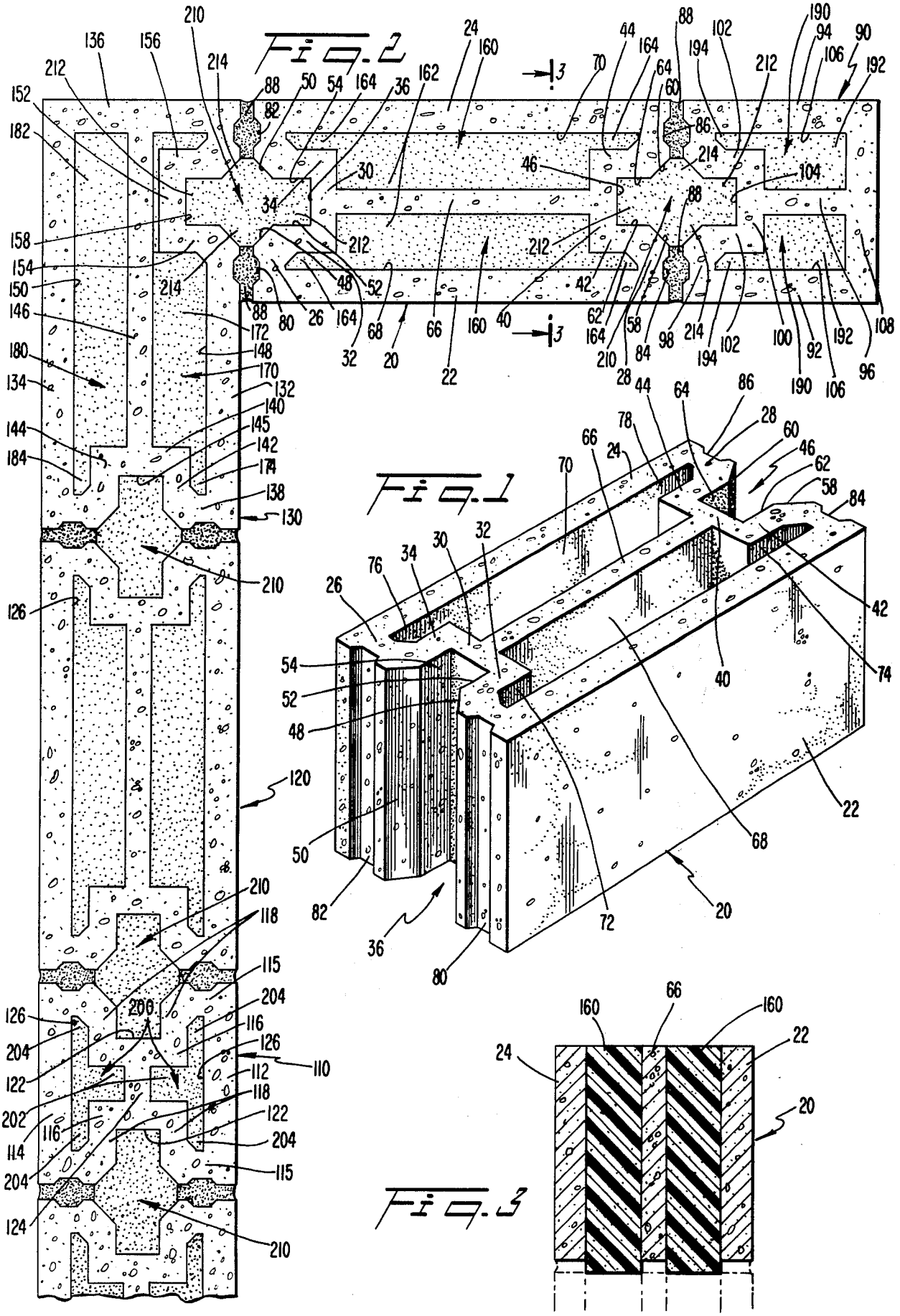
FIG. 1 is a perspective view of a construction block constructed in accordance with the principles of the invention.
FIG. 2 is a plan view of a row of construction blocks in a masonry wall illustrating a full block, half block, corner block and jamb block, together with suitable inserts of insulating material adapted to be inserted into the insulating spaces provided within the blocks and between adjacent blocks.
FIG. 3 is a vertical section of a full construction block taken along line 3—3 of FIG. 2.

Referring to FIG. 1, a preferred embodiment of the insulated construction block, generally 20, provides a configuration especially suitable for large eight inch and twelve inch concrete blocks. Construction block 20, illustrated as a full block, includes a pair of spaced vertical side walls 22 and 24 which provide an inner side wall and an outer side wall, respectively, of the block. A pair of end walls 26 and 28 is connected to opposite ends of the vertical side walls. Side walls 22 and 24 and end walls 26 and 28 define a hollow interior region within the block for receiving insulating material.

As shown in FIGS. 1 and 2, end wall 26 of the construction block includes an intermediate portion 30 offset inwardly into the hollow interior region. Offset portion 30 is centrally located on end wall 26 and connected by a pair of longitudinally extending legs 32 and 34 to the main portion of the end wall. Offset portion 30 and longitudinal legs 32 and 34 provide a vertical recess 36 on the exterior of end wall 26 for receiving insulating material. Similarly, end wall 28 includes an intermediate portion 40 offset inwardly into the hollow interior region and connected by a pair of longitudinal legs 42 and 44 to the main portion of the end wall. Offset central portion 40 and longitudinal legs 42 and 44 provide a vertical recess 46 on the exterior of end wall 28 for receiving insulating material.

In accordance with a preferred feature of the present invention, each recess has an enlarged portion adjacent to the exterior of its end wall to increase the amount of insulating material received therein. Referring to FIGS. 1 and 2, recess 36 includes an outer enlarged portion provided by outwardly flared surfaces 48 and 50 formed at the outer ends of longitudinal legs 32 and 34, respectively. The recess also includes an inner rectangular portion defined by outside vertical edges 52 and 54 of legs 32 and 34, respectively, and the outside vertical edge of offset portion 30 of the end wall 26. Similarly, recess 46 includes an outer enlarged portion defined by outwardly flared surfaces 58 and 60 at the outer ends of longitudinal legs 42 and 44, respectively, and an inner rectangular portion defined by outside vertical edges 62 and 64 of legs 42 and 44, respectively, and the outside vertical edge of offset portion 40 of end wall 28. Recesses 36 and 46 are identical in size and configuration. The outer flared portion of each recess reduces the weight of block 20.

In the preferred embodiment of FIGS. 1 and 2, a longitudinal web 66 extends between offset portion 30 of end wall 26 and offset portion 40 of end wall 28. Longitudinal web 66 is centrally located and spaced from vertical side walls 22 and 24 to form longitudinal insulating spaces 68 and 70, respectively, adjacent to the inner side wall and outer side wall of the block. Insulating space 68 includes a pair of longitudinal extensions 72 and 74 located in the spaces between the inside edges of legs 32 and 42 and side wall 22. Similarly, insulating space 70 includes a pair of longitudinal extensions 76 and 78 formed in the spaces between the inside edges of legs 34 and 44 and side wall 24. Longitudinal web 66 serves to provide rigidity to end walls 26 and 28 and to preserve the strength of the block.

As shown in FIGS. 1 and 2, offset portion 30 of end wall 26 extends sufficiently inward into the hollow interior region of block 20 to allow the inner rectangular portion of recess 36 to overlap extensions 72 and 76 of longitudinal insulating spaces 68 and 70, respectively. As a result, there is no direct path for thermal conduction between inner side wall 22 and outer side wall 24. Any heat conducted through end wall 26 must travel along the extended path provided by offset portion 30 and longitudinal legs 32 and 34. The same configuration exists at opposite end wall 28 where any heat conduction through the end wall must follow the path provided by offset portion 40 and longitudinal legs 42 and 44. Consequently, thermal conduction through end walls 26 and 28 is minimized.

In addition, longitudinal web 66 is reduced in thickness relative to side walls 22 and 24 to accommodate an increased amount of insulating material within longitudinal insulating spaces 68 and 70. For example, side walls 22 and 24 may be made one and one-quarter inches in thickness, while longitudinal web 66 may be made one inch or less in thickness. The reduction in thickness of the longitudinal web allows the insulative characteristics of the block to be optimized.

Typically, the overall dimensions of a nominal eight inch construction block 20 are $7\frac{5}{8}'' \times 7\frac{5}{8}'' \times 15\frac{5}{8}''$. Preferably, the block walls are tapered vertically to provide increased thickness of the concrete material at the bottom of the block. For example, each side wall may be tapered from a top thickness of one and one-quarter inches to a bottom thickness of one and one-half inches. Similarly, longitudinal web 66 may also be tapered from a top thickness of one inch to a bottom thickness of one and one-quarter inches. The tapered walls and longitudinal web enhance the load bearing capacity of the block.

As shown in FIG. 1, construction block 20 includes a pair of vertical notches 80 and 82 formed adjacent to the opposite outer edges of end wall 26. Similar vertical notches 84 and 86 are formed adjacent to the opposite outer edges of end wall 28. When block 20 is assembled by a set of mortar joints 88 (FIG. 2) to adjacent blocks in a masonry wall, these vertical notches are filled with mortar to securely hold the blocks together.

Referring to FIG. 2, it is also contemplated that the preferred structure exemplified by full construction block 20 may also be embodied in a jamb block 90, a half block 110 and a corner block 130. The wall also includes an additional full block 120 which is identical in structure to block 20.

Although jamb block 90 (FIG. 2) is illustrated in the form of a half jamb block, its basic structure is also representative of a full jamb block. Jamb block 90 includes an inner side wall 92, an outer side wall 94, and a longitudinal central web 96 which is preferably reduced in thickness relative to the side walls. One end wall 98 of the jamb block includes an offset portion 100 joined by a pair of longitudinal legs 102 to the main portion of end wall 98. Offset portion 100 and longitudinal legs 102 form a recess 104 which is identical in size and configuration to recess 36 provided in full construction block 20. Longitudinal web 96 divides the hollow interior of jamb block 90 into two identical insulating spaces or cavities 106, each having a longitudinal extension formed by the space between legs 102 and side walls 92 and 94, respectively. An opposite end wall 108 of jamb block 90 has a flat exterior face to allow the block to abut an opening in the masonry wall for a window or door.

Half block 110 is substantially identical in configuration to full block 20, but only one-half of the length of the full block. Half block 110 includes an inner side wall 112, an outer side wall 114 and a pair of end walls 115. Each end wall 115 includes an intermediate portion 116 offset inwardly into the hollow interior region of the block and connected by a pair of longitudinal legs 118 to the main portion of the end wall. Offset portion 116 and legs 118 define a vertical recess 122 in each end wall which is identical in configuration to recess 36 of full construction block 20. A longitudinal central web 124, which is preferably reduced in thickness relative to side walls 112 and 114, connects central offset portions 118 of the end walls. Longitudinal web 124 divides the hollow interior of half block 110 into two identical insulating spaces or cavities 126, each having a pair of narrow extensions at its opposite ends in the spaces between legs 116 and side walls 112 and 114.

Corner block 130 includes an inner side wall 132, an outer side wall 134 and an end wall 136 having a flat exterior face to be located at the corner of a masonry wall. An opposite end wall 138 includes an intermediate portion 140 offset inwardly into the hollow interior of the block and connected by a pair of longitudinal legs 142 and 144 to the main portion of the end wall. Offset portion 140 and longitudinal legs 142 and 144 provide a vertical recess 145 on the exterior of end wall 138 which is identical in configuration to recess 36 of full construction block 20. A longitudinal central web 146 extending between central offset portion 140 and end wall 136 divides the hollow interior of corner block 130 into a pair of longitudinal insulating spaces 148 and 150 for receiving insulating material.

To allow corner block 130 to perpendicularly abut an adjacent block, e.g., full block 20, a portion 152 of side wall 132 is offset inwardly into insulating space 148 and connected by a pair of laterally extending legs 154 and 156 to the main portion of the side wall. Offset portion 152 and lateral legs 154 and 156 provide a vertical recess 158 on the exterior of side wall 132 which is identical in configuration to recess 36 of full construction block 20. In an alternative form of corner block 130 (not shown), a portion of opposite side wall 134 is offset inwardly to provide an exterior vertical recess, while side wall 132 is straight to allow the corner to be formed on the opposite side of the block.

Figure 4:
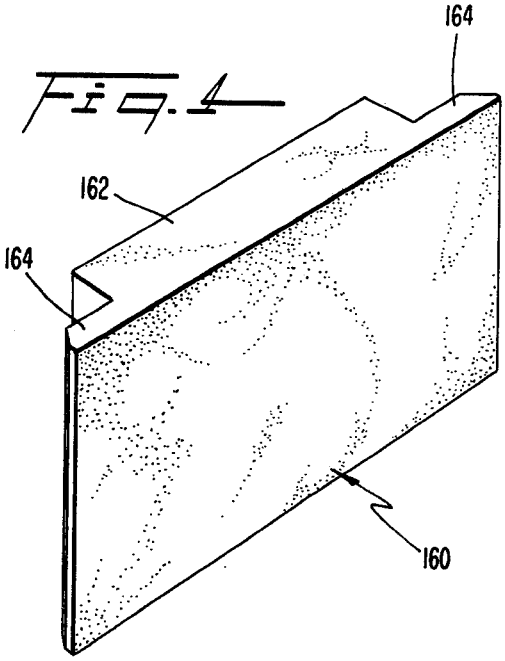
FIGS. 4–9 are perspective views of the various insulating inserts required for the construction blocks shown in FIG. 2.

Although it is possible to fill the various insulating spaces within and between the blocks with loose insulation, a preferred form of the invention utilizes rigid panels or inserts of insulating material, e.g., polystyrene or polyurethane, to provide the desired insulation. Referring to FIG. 4, an insulating insert, generally 160, adapted for insertion into longitudinal insulating spaces 68 and 70 of full construction block 20 (FIGS. 1 and 2) includes a wide central portion 162 to be located adjacent to longitudinal web 66. Insert 160 also includes a pair of narrow extensions 164 at its opposite ends suitably shaped to be received in the spaces between the inside edges of longitudinal legs 32 and 42 and side wall 22 and, similarly, in the spaces between the inside edges of longitudinal legs 34 and 44 and outer side wall 24.

As shown in FIG. 3, each insulating insert 160 is slightly greater in height than vertical side walls 22 and 24 of the construction block. For example, the block may be $7\frac{5}{8}$ inches in height while the insulating inserts are each eight inches (8") high. The extra height of insulating insert 160 allows each insert to extend into the horizontal mortar joint below the bottom of construction block 20 to provide insulation in the mortar joint. Alternatively, the insulating insert may extend above the top of the block to provide insulation in the mortar joint above the block.

Figure 5:
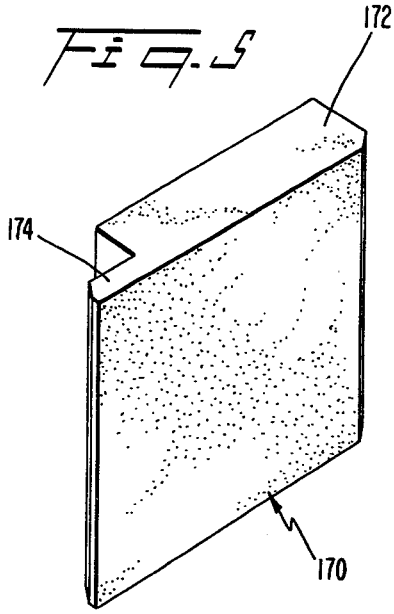
Figure 6:
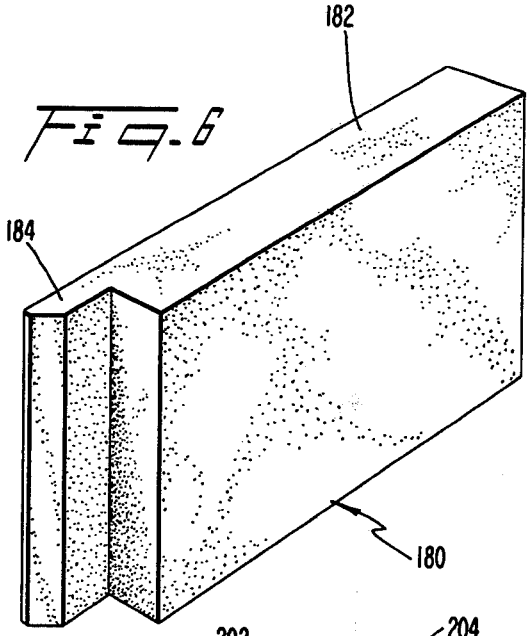

Referring to FIGS. 5 and 6, a pair of insulating inserts 170 and 180 is provided to fill insulating spaces 148 and 150 (FIG. 2), respectively, of corner block 130. Insulating insert 170 (FIG. 5) includes a wide elongated portion 172 adapted to be located adjacent to central web 146 to fill the space between offset portion 140 and lateral leg 154. The insert also includes a narrow extension 174 adapted to fill the space between the inside edge of longitudinal leg 142 and inner side wall 132. The narrow space between the inner edge of offset portion 152 and central web 146 and the space between lateral leg 156 and end wall 136 may be left empty or, if desired, filled with insulating material. Insulating insert 180 (FIG. 6) is longer than insert 170 to fill insulating space 150 located between central web 146 and outer side wall 134. In addition, insert 180 includes a narrow extension 184 shaped to fill the space between the inside edge of longitudinal leg 144 and outer side wall 134.

Figure 7:
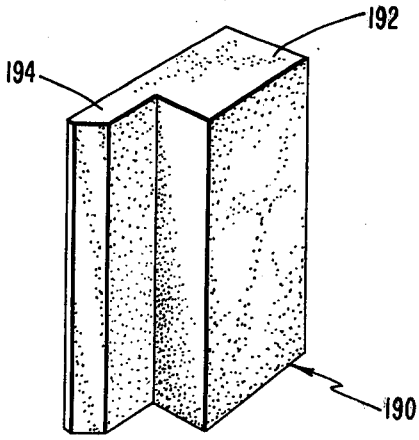

As shown in FIG. 7, an insulating insert 190 is adapted to fill each cavity 106 within half jamb block 90 (FIG. 2). Insert 190 includes a wide rectangular portion 192 adapted to fill the space between central web 96 and side walls 92 and 94. The insert also includes a narrow extension 194 adapted to fill each space between longitudinal legs 102 and 104 and the side walls. In the case of a full jamb block, a pair of elongated insulating inserts identical to insert 180 (FIG. 6) is employed.

Figure 8:
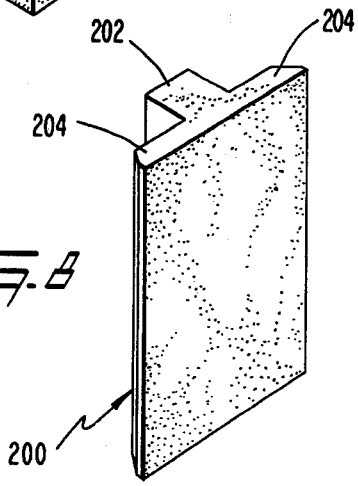

Referring to FIG. 8, an insulating insert 200 is provided for insertion into each cavity 126 within half block 110 (FIG. 2). Insulating insert 200 includes a widened central portion 202 adapted to fill the space between central web 124 and side walls 112 and 114. The insert also includes a pair of narrow extensions 204 adapted to fill the spaces between longitudinal legs 118 and the side walls.

Each of the insulating inserts (FIGS. 5–8) provided for insertion into the interior spaces of the corner block, jamb block and half block, line inserts 160 (FIGS. 3 and 4) for the full construction block, is slightly greater in height than the walls of the block. The extra height of the insulating inserts allows each insert to project above or below the block to provide insulation in the horizontal mortar joint between successive rows of blocks. If desired, the insulating inserts may be tapered to compensate for the tapered thickness of the side and end walls and the longitudinal web of the construction blocks. Otherwise, the inserts may be uniform in thickness and forced downward into the various insulating spaces in the blocks.

Figure 9:
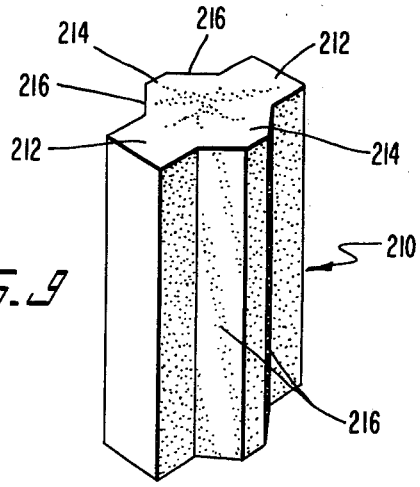

The invention also contemplates an insert of insulating material adapted for insertion into the insulating space formed by the recesses of adjacent blocks to provide insulation in the vertical mortar joint between the blocks. As shown in FIG. 9, an insulating insert 210, which is generally rectangular in configuration, includes a pair of opposed rectangular ends 212 and a pair of enlarged center portions 214 formed on opposite sides of the insert. Each rectangular portion 212 of the insert is adapted to be received within the inner rectangular portion of recess 36 of full construction block 20 (FIGS. 1 and 2). Each enlarged center portion 214 includes a pair of outwardly tapered walls 216 (FIG. 9) adapted to fill the outer enlarged portion of recess 36 (FIG. 2) defined by flared edges 48 and 50.

As shown in FIG. 2, since recess 36 is identical in size and configuration to recess 46 of full block 20 and the other recesses provided in the jamb block, half block and corner block, one insulating insert 210 may be inserted in the space provided by the recesses at each mortar joint to provide insulation between each adjacent pair of blocks. For example, at the mortar joint between full block 20 and half jamb block 90, rectangular portions 212 of insulating insert 210 overlap extensions 164 of insert 160 and extensions 194 of insulating insert 190 to minimize thermal conduction through the end walls of the block. In addition, enlarged center portions 214 of insulating insert 210 provide an increased amount of insulation in the mortar joint itself to minimize thermal conductivity through the mortar joint. Furthermore, insulating insert 210 is slightly greater in height than the end walls of the blocks to allow the insert to extend into the horizontal mortar joint above or below the blocks.

An alternative embodiment (FIGS. 10 and 11) provides a configuration particularly suitable for four inch and six inch construction blocks typically employed to construct a backup masonry wall for a brick face. However, it is also possible to employ the same configuration in larger eight inch and twelve inch construction blocks.

Referring to FIG. 10, an alternative embodiment of the insulated construction block, generally 220, includes a pair of spaced vertical side walls 222 and 224 which provide an inner side wall and an outer side wall, respectively, of the block and a pair of end walls 226 and 228 connected to opposite ends of the vertical side walls. Side walls 222 and 224 and end walls 226 and 228 define a hollow interior region within the block for receiving insulating material.

As shown in FIGS. 10 and 11, end wall 226 of the construction block includes an intermediate portion 230 offset inwardly into the hollow interior region. Offset portion 230 is centrally located on end wall 226 and connected by a pair of longitudinally extending legs 232 and 234 to the main portion of the end wall. Offset portion 230 and longitudinal legs 232 and 234 provide a vertical recess 236 on the exterior of end wall 226 for receiving insulating material. Similarly, end wall 228 includes an intermediate portion 240 offset inwardly into the hollow interior region and connected by a pair of longitudinal legs 242 and 244 to the main portion of the end wall. Offset portion 240 and longitudinal legs 242 and 244 provide a vertical recess 246 on the exterior of end wall 228 for receiving insulating material.

In accordance with a preferred feature of the present invention, each recess has an enlarged portion adjacent to the exterior of its end wall to increase the amount of insulating material received therein. Referring to FIGS. 10 and 11, recess 236 includes an outer enlarged portion provided by outwardly flared surfaces 248 and 250 formed at the outer ends of longitudinal legs 232 and 234, respectively. The recess also includes an inner rectangular portion defined by outside vertical edges 252 and 254 of legs 232 and 234, respectively, and the outside vertical edge of offset portion 230 of end wall 226. Similarly, recess 246 includes an outer enlarged portion defined by outwardly flared surfaces 258 and 260 formed at the outer ends of longitudinal legs 242 and 244, respectively, and an inner rectangular portion defined by outside vertical edges 262 and 264 of legs 242 and 244, respectively, and the outside vertical edge of offset portion 240 of end wall 228. Recesses 236 and 246 are identical. The outer flared portion of each recess reduces the weight of block 220.

In the alternative embodiment of FIGS. 10 and 11, a connecting web, generally 270, extends transversely between inner side wall 222 and outer side wall 224. Transverse connecting web 270 includes a first transverse portion 272 extending inwardly from inner side wall 222 and a second transverse portion 274 extending inwardly from outer side wall 224 at a position spaced longitudinally from first transverse portion 272. The connecting web includes a third longitudinal portion 276 connecting first and second transverse portions 272 and 274, respectively.

Transverse connecting web 270 is located at a central position within construction block 220 to divide its hollow interior region into two insulating spaces 278 and 280 which are substantially identical in configuration. Insulating space 278 includes a pair of longitudinal extensions 282 and 284 located in the spaces between the inside edges of legs 232 and 234 and side walls 222 and 224, respectively (FIG. 11). Similarly, insulating space 280 includes a pair of longitudinal extensions 286 and 288 formed in the spaces between the inside edges of legs 242 and 244 and side walls 222 and 224, respectively. Transverse web 270 also serves to strengthen the side walls and enhance the rigidity of the block. Preferably, the block walls and transverse web are vertically tapered to enhance its load bearing strength.

As shown in FIGS. 10 and 11, offset portion 230 of end wall 226 extends sufficiently inward into the hollow interior region of block 220 to allow the inner portion of recess 236 to overlap extensions 282 and 284 of interior insulating space 278. As a result, there is no direct path for thermal conduction between inner side wall 222 and outer side wall 224. Any heat conducted through end wall 226 must travel along the extended path provided by offset portion 230 and longitudinal legs 232 and 234. The same configuration exists at opposite end wall 228 where any heat conduction through the end wall must follow the path provided by offset portion 240 and longitudinal legs 242 and 244. Consequently, thermal conduction through end walls 226 and 228 is minimized.

Construction block 220 includes a pair of vertical notches 290 and 292 (FIG. 10) formed adjacent to the opposite outer edges of end wall 226. Similar vertical notches 294 and 296 (FIG. 11) are formed adjacent to the opposite outer edges of end wall 228. As shown in FIG. 11, when a row of blocks 220 is assembled by a set of mortar joints 298 in a masonry wall, these vertical notches are filled with mortar to securely hold the blocks together.

Referring to FIG. 15, it is also contemplated that the alternative structure exemplified by full construction block 220 may also be embodied in a corner block 300. The corner block includes an inner side wall 302, an outer side wall 304 and an end wall 306 having a flat exterior face to be located at the corner of a masonry wall. An opposite end wall 308 includes an intermediate portion 310 offset inwardly into the hollow interior of the block and connected by a pair of longitudinal legs 312 to the main portion of the end wall. Offset portion 310 and longitudinal legs 312 provide a vertical recess 314 on the exterior of end wall 308 which is identical in configuration to recess 236 of full construction block 220.

A connecting web, generally 320, extends transversely between inner side wall 302 and outer side wall 304. Transverse connecting web 320 includes a first transverse portion 322 extending inwardly from inner side wall 302 and a second transverse portion 324 extending inwardly from outer side wall 304 at a position spaced longitudinally from first transverse portion 322. A third longitudinal portion 326 connects first and second transverse portions 322 and 324, respectively. The transverse connecting web is centrally located to divide the hollow interior of corner block 300 into two insulating spaces 328 and 330 for receiving insulating material. The connecting web also serves to strengthen the side walls and enhance the rigidity of the block.

To allow corner block 300 to perpendicularly abut an adjacent block, e.g., a full block 220', a portion 332 of side wall 302 is offset inwardly into insulating space 330 and connected by a pair of laterally extending legs 334 and 336 to the main portion of the side wall. Offset portion 332 and lateral legs 334 and 336 provide a vertical recess 338 on the exterior of side wall 302 which is identical in configuration to recess 236 of full construction block 220. In an alternative form of corner block 300 (not shown), a portion of opposite side wall 304 is offset inwardly to provide an exterior vertical recess, while side wall 302 is straight to allow the corner to be formed on the opposite side of the block.

Although the various insulating spaces within and between the blocks may be filled with loose insulation, it is preferable to utilize rigid panels or inserts of insulating material, e.g., polystyrene or polyurethane, to provide the desired insulation. Referring to FIG. 13, an insulating insert, generally 340, is provided with a suitable exterior shape for insertion into interior insulating spaces 278 and 280 (FIGS. 10 and 11) of full construction block 220. The insulating insert 340 includes an indentation 342 on an end face of the insert which provides a pair of narrow extensions 344 suitably shaped to be received in the spaces between the inside edges of longitudinal legs 232 and 234 and side walls 222 and 244, respectively. Since interior insulating spaces 278 and 280 are identical, extensions 344 and also adapted to fill the spaces between the inside edges of longitudinal legs 242 and 244 and the side walls. In addition, insulating insert 340 includes an extended portion 346 at its opposite end face to conform to the shape of transverse connecting web 270.

As shown in FIG. 12, each insulating insert 340 is slightly greater in height than vertical side walls 222 and 224 of the construction block. The extra height of insulating insert 340 allows each insert to extend into the horizontal mortar joint below construction block 220 to provide insulation in the mortar joint. Alternatively, the insulating insert may extend above the top of the block to provide insulation in the mortar joint above the block.

Referring to FIG. 16, an insulating insert 350 is provided to fill interior insulating space 330 (FIG. 15) of corner block 300. Insulating insert includes an indentation 352 on a side face of the insert which provides a first, narrow extension 354 suitably shaped to fill the space between the inside edge of lateral leg 334 and end wall 306 of corner block 300. A second, enlarged extension 356 is also provided to fill the space between lateral leg 336 and transverse portion 322 of connecting web 320. Insulating insert 350 is also slightly greater in height than the side and end walls of corner block 300 to allow a portion of the insert to project above or below the block.

The alternative embodiment also includes an insert of insulating material adapted for insertion into the insulating space formed by the recesses of adjacent blocks to provide insulation in the vertical mortar joint between the blocks. Referring to FIG. 14, an insulation insert, generally 360, is provided for insertion into the various insulating spaces between adjacent blocks in the masonry wall. Insulating insert 360 is generally rectangular in configuration and includes a pair of opposed rectangular ends 362 suitably shaped to conform to the inner rectangular portions of recesses 236 and 246 in full construction block 220 and to the inner rectangular portions of recesses 314 and 338 of corner block 300. The insulating insert also includes a pair of enlarged center portions 364 formed on its opposite sides. Each extension 364 includes a pair of outwardly tapered walls 366 adapted to fill the outer enlarged portion of recess 236 (FIG. 11) defined by flared edges 248 and 250.

As shown in FIGS. 11 and 15, with the insulating inserts assembled in the masonry wall, rectangular portion 362 of insert 360 overlaps extensions 344 of insert 340 to prevent any direct thermal conduction through the end walls of the blocks. In addition, enlarged center portions 364 of insert 360 are located in the vertical mortar joint to provide maximum insulation in the mortar joint itself. Moreover, extensions 346 of insulating inserts 340 overlap adjacent to longitudinal portion 276 of connecting web 270 to reduce thermal conduction through the center of the blocks. Consequently, each construction block is thoroughly insulated against thermal conduction through the concrete material of the block and through the mortar joints between adjacent blocks.

Referring to FIG. 17, another alternative embodiment of the insulated construction block, generally 420, provides a configuration especially suitable for use in connection with narrow four inch concrete blocks. Construction block 420 includes a pair of spaced vertical side walls 422 and a pair of end walls 424 connected to opposite ends of the vertical side walls. Side walls 422 and end walls 424 define a hollow interior region within the block for receiving insulating material.

Each end wall 424 includes an intermediate portion 426 offset inwardly into the hollow interior region. Each offset portion 426 is centrally located on its end wall 424 and connected by a pair of longitudinal legs 428 to the main portion of the end wall. Offset portion 426 and longitudinal legs 428 provide a vertical recess 430 on the exterior of each end wall 424 for receiving insulating material. Each recess 430 includes an outer enlarged portion formed by outwardly flared surfaces 432 formed at the outer ends of longitudinal legs 428. The recess also includes an inner rectangular portion defined by the outside vertical edges of legs 428 and the outside vertical edge of offset portion 426.

An insulating insert, similar to insert 360 (FIG. 14) is suitably shaped to fill the insulating spaces provided by recesses 430 between adjacent blocks 420 in a masonry wall. In addition, an insulating insert (not shown) is suitably shaped to fill the hollow interior region within construction block 420.

Referring to FIG. 18, a further alternative embodiment of an insulated construction block, generally 520, provides a configuration especially suitable for use in connection with wide eight inch and twelve inch concrete blocks. The construction block includes a pair of spaced vertical side walls 522 and a pair of end walls 524 connected to opposite ends of the vertical side walls. Side walls 522 and end walls 524 define a hollow interior region within the block for receiving insulating material.

Each end wall 524 includes an intermediate portion 526 offset inwardly to the hollow interior region. Offset portion 526 is centrally located on each end wall 524 and connected by a pair of legs 528 to the main portion of its end wall. Offset portion 526 and longitudinal legs 528 provide a vertical recess 530 on the exterior of each wall 524 for receiving insulating material. Each recess 530 has an outer enlarged portion formed by outwardly flared surfaces 532 formed at the outer ends of legs 528. The recess also includes an inner rectangular portion defined by the outside vertical edges of legs 528 and the outside vertical edge of offset portion 526.

Construction block 520 includes a pair of elongated webs 534 extending inwardly from opposite end walls 524 and intersecting in a crisscross configuration between the end walls of the block. Intersecting webs 534 divide the hollow interior region of the block into a first pair of triangular spaces 536 adjacent to offset portions 526 and a second pair of elongated triangular spaces 538 adjacent to side walls 522 for receiving insulating material.

An insulating insert, similar to insert 360 (FIG. 14), is suitably shaped to fill the insulating spaces provided by recesses 530 between adjacent blocks 520 in a masonry wall. In addition, a plurality of triangularly shaped insulating inserts (not shown) is provided for insertion into insulating spaces 536 and 538 within the construction block.

The present invention is not limited to the specific details shown and described, and modifications may be made in the various embodiments of the insulated construction block without departing from the principles of the invention.

What is claimed is:

1. A construction block, comprising:

a pair of spaced vertical side walls providing an inner side wall and an outer side wall of the block;

a pair of end walls connected to opposite ends of said vertical side walls;

said side and end walls defining a hollow interior region within the block for receiving insulating material;

at least one of said end walls including an intermediate portion offset inwardly into said hollow interior region to provide a vertical recess on the exterior of said end wall for receiving insulating material;

a longitudinal web extending from said offset portion of said one end wall to the opposite end wall and spaced from said vertical side walls to divide said hollow interior region into longitudinal insulating spaces adjacent to said inner side wall and said outer side wall for receiving the insulating material;

each longitudinal insulating space extending along substantially the entire length of the block and being substantially uniform in thickness and including an extension of reduced thickness located between said offset portion of said one end wall and one of said side walls and overlapping said recess in said one end wall;

said recess having an enlarged portion adjacent to the exterior of said end wall to increase the amount of insulating material received therein; and a pair of inserts of insulating material adapted for insertion into said longitudinal insulating spaces, each insert including an elongated portion of substantially uniform thickness to be located adjacent to said longitudinal web and an extension of reduced thickness to be received between said offset portion of said one end wall and one of said side walls.

2. The construction block of claim 1, wherein:

said recess is flared outwardly adjacent to the exterior of said one end wall to provide said enlarged portion and includes an inner rectangular portion overlapping said extensions of said longitudinal insulating spaces to minimize thermal conduction through the block.

3. The construction block of claim 1, wherein:

said longitudinal web is reduced in thickness relative to said side walls to accommodate an increased amount of insulating material within said longitudinal insulating spaces.

4. The construction block of claim 1, which includes:

an insert of insulating material adapted for insertion into said recess and provided with an enlarged portion to be received in said outer enlarged portion of said recess to provide insulation in a mortar joint adjacent to said one end wall of the block.

5. The construction block of claim 4, wherein:

said insulating insert is greater in height than said one end wall to allow said insert to project above or below the block.

6. The construction block of claim 1, wherein:

each insulating insert is greater in height than said vertical side walls to allow said insert to project above or below the block.

7. The insulated construction block of claim 1, wherein:

one of said side walls includes a portion offset inwardly into said hollow interior region at a position spaced from said opposite end wall to provide a vertical recess on the exterior of said one side wall for receiving insulating material, said recess having an outer enlarged portion adjacent to the exterior of said one side wall to increase the amount of insulating material received therein.

8. The construction block of claim 7, wherein:

said recess is flared outwardly adjacent to the exterior of said one side wall to provide said enlarged portion.

9. The construction block of claim 1, wherein:

said one end wall includes a pair of inwardly extending legs connected to said offset portion to define said vertical recess, each leg being spaced from one of said side walls to define said extensions of said longitudinal insulating spaces.

10. An insulated construction block, comprising:

a pair of spaced vertical side walls providing an inner side wall and an outer side wall of the block;

a pair of end walls connected to opposite ends of said vertical side walls;

a central web extending longitudinally between said end walls and spaced from said vertical side walls to form longitudinal insulating spaces adjacent to said inner side wall and said outer side wall for receiving insulated material;

each end wall including an intermediate portion connected to said central web and offset inwardly into said insulating spaces to provide a vertical recess on the exterior of said end wall for alignment with a similar recess of an adjacent block to form an insulating space between the blocks;

each longitudinal insulating space extending along substantially the entire length of the block and being substantially uniform in thickness and including a pair of narrow extensions at its opposite ends located between said offset portions of said end walls and one of said side walls and overlapping said recesses in said end walls;

each recess having an outer enlarged portion adjacent to the exterior of its end wall to increase the amount of insulating material received in the insulating space between the blocks; and a pair of inserts of insulating material adapted for insertion into said longitudinal insulating spaces, each insert including a wide central portion to be located adjacent to said longitudinal web and a pair of narrow extensions at its opposite ends to be received between said offset portions of said end walls and said side walls.

11. The construction block of claim 10, wherein:

each recess is flared outwardly adjacent to the exterior of its end wall to provide said enlarged portion and includes an inner rectangular portion overlapping said extensions of said longitudinal insulating spaces to minimize thermal conduction through the block.

12. The construction block of claim 10, wherein:

said longitudinal web is reduced in thickness relative to said side walls to accommodate an increased amount of insulating material within said longitudinal insulating spaces.

13. The construction block of claim 10, which includes:

an insert of insulating material adapted for insertion into the insulating space formed between adjacent blocks and provided with an enlarged central portion to be received in said outer enlarged portion of each recess.

14. The construction block of claim 13, wherein:

said insulating insert is greater in height than said end walls to allow said insert to project above or below the block.

15. The construction block of claim 10, wherein:

each insulating insert is greater in height than said vertical side walls to allow said insert to project above or below the block.

16. The insulated construction block of claim 10, wherein:

each end wall includes a pair of inwardly extending legs connected to said offset portion to define said vertical recess, each leg being spaced from one of said side walls to define said extensions of said longitudinal spaces.

* * * * *